US008082714B2

(12) United States Patent
Burns et al.

(10) Patent No.: US 8,082,714 B2
(45) Date of Patent: Dec. 27, 2011

(54) ROTATABLE WEDGE TILE SPACER HAVING A CURVED BODY

(76) Inventors: Jason W. Burns, Palm Desert, CA (US); Grant B. Jones, Carlsbad, CA (US)

( * ) Notice: Subject to any disclaimer, the term of this patent is extended or adjusted under 35 U.S.C. 154(b) by 248 days.

(21) Appl. No.: 12/386,227

(22) Filed: Apr. 14, 2009

(65) Prior Publication Data

US 2009/0260317 A1 Oct. 22, 2009

Related U.S. Application Data

(60) Provisional application No. 61/045,810, filed on Apr. 17, 2008.

(51) Int. Cl.
*E04F 13/00* (2006.01)

(52) U.S. Cl. ..... 52/390; 33/526; 52/749.11

(58) Field of Classification Search ..... 52/126.1, 52/389, 391, 396.08, 396.1, 749.11, 390; 33/526, 527, 567, 567.1, DIG. 20; 411/538, 411/537, 546

See application file for complete search history.

(56) References Cited

U.S. PATENT DOCUMENTS

| | | | | |
|---|---|---|---|---|
| 69,953 | A * | 10/1867 | Richards | 33/567 |
| 4,688,363 | A * | 8/1987 | Sweeney et al. | 52/562 |
| 4,908,952 | A * | 3/1990 | Joos | 33/526 |
| 5,110,151 | A * | 5/1992 | Blechschmidt et al. | 280/86.753 |
| 5,413,441 | A * | 5/1995 | Heminger et al. | 411/55 |
| 5,623,799 | A * | 4/1997 | Kowalski et al. | 52/392 |
| 5,640,813 | A * | 6/1997 | Glazik et al. | 52/126.1 |
| 5,974,741 | A * | 11/1999 | Fukuhara | 52/20 |
| D493,700 | S * | 8/2004 | O'Neill | D8/374 |
| 7,322,620 | B1 * | 1/2008 | Lawrence | 292/242 |
| 7,516,558 | B2 * | 4/2009 | Frank et al. | 33/526 |
| 7,784,751 | B1 * | 8/2010 | Bellows et al. | 248/188.2 |
| 2006/0144011 | A1 * | 7/2006 | Symington | 52/782.1 |
| 2007/0214743 | A1 * | 9/2007 | Alvarez | 52/749.11 |
| 2010/0050453 | A1 * | 3/2010 | Bryce | 33/527 |

FOREIGN PATENT DOCUMENTS

| | | | |
|---|---|---|---|
| JP | 2004075263 | A * | 3/2004 |
| WO | WO 02/06609 | | 1/2002 |

* cited by examiner

*Primary Examiner* — Robert Canfield
*Assistant Examiner* — Christine T Cajilig
(74) *Attorney, Agent, or Firm* — Morland C. Fischer

(57) ABSTRACT

A rotatable wedge tile spacer to be removably positioned in a gap between adjacent upper and lower tiles that are being bonded one above the other to a vertical surface (i.e., a wall). The tile spacer includes a curved (i.e., circular) body having a thin tip at one end and a thick tail at the opposite end. The height of the circular body increases along a tile-supporting top surface thereof that runs from the thin tip to the thick tail. With the tile spacer seated upon the lower tile, the circular body is rotated continuously around its longitudinal axis until the tile-supporting top surface engages the upper tile. Accordingly, the circular body of the rotatable wedge tile spacer will fill the gap and thereby prevent the upper tile from moving through the gap towards the lower tile during the bonding process.

8 Claims, 3 Drawing Sheets

ROTATABLE WEDGE TILE SPACER HAVING A CURVED BODY

CROSS REFERENCE TO RELATED APPLICATIONS

This application is related to Provisional Patent Application No. 61/045,810 filed Apr. 17, 2008.

BACKGROUND OF THE INVENTION

1. Field of the Invention

This invention relates to a rotatable wedge spacer having a curved (i.e., circular) body to be removably located between a pair of adjacent tiles that are bonded to a vertically-extending substrate (i.e., a wall) by means of mortar, or the like, so as to preserve the original positions of the tiles relative to one another as the mortar solidifies. The circular body of the rotatable wedge spacer represents an improvement over the conventional triangular wedge spacer having a linear body.

2. Background Art

To enhance the ornamental appearance of a wall or other flat surface inside a home, around a pool, or at a commercial building complex, it is common to bond decorative tiles to the wall. That is, a variety of colored and/or ornamental tiles are traditionally bonded to the wall by means of mortar or a similar adhesive material. The tiles are usually separated from one another by a gap, and the gap is filled with grout, or the like.

Particularly in the case of a vertical wall, the tiles are known to shift relative to one another by sliding under the influence of gravity during the time required for the mortar to set and harden. Consequently, the gaps between adjacent pairs of tiles will not be uniform, whereby the final tile configuration will appear uneven or unbalanced. As the mortar dries, it may become more difficult and/or time-consuming to relocate the tiles to their original positions, especially where many tiles have shifted closer together.

To overcome the problem of the tiles sliding over a surface to which they are to be adhesively bonded, it is known to insert a planar wedge spacer into the gap between a pair of adjacent tiles. What is more, because the tiles often vary slightly in size, an adjustable height spacer is needed to compensate for these size variations in order to obtain uniform grout joints. Referring in this regard to FIG. 1 of the drawings, there is shown a conventional planar wedge spacer 1. The conventional wedge spacer 1 has a triangular body 3 and a continuous linear tile-supporting top surface 5 that extends between a relatively narrow tip 7 at one end of the body 3 and a wide back 9 at the opposite end of the body. The conventional planar wedge spacer 1 is manufactured from plastic and typically has a maximum length (along the linear top surface 5) of about 2.9 cm and a maximum height (at the back 9) of about 8 mm. It may be appreciated that the height of the triangular body 3 of wedge spacer 1 varies continuously along the top surface 5 between the tip 7 and the back 9.

FIGS. 2A and 2B of the drawings show the conventional planar wedge spacer 1 after being inserted in a gap 11 established between a pair of adjacent tiles 13 and 15 that are located one above the other to be adhesively bonded to an upstanding vertical wall 17 by means of a layer of mortar 19. The tip 7 of wedge spacer 1 is pushed inwardly through the gap 11 so as to be held in place between the tiles 13 and 15 by the mortar 19. As best shown in FIG. 2A, the upper tile 13 of the pair of tiles 13 and 15 to be spaced from one another will engage the tile supporting surface 5 atop the triangular body 3 of the planar wedge spacer 1 to prevent the upper tile 13 from sliding towards the lower tile 15 in order to preserve the gap 11 therebetween.

The conventional planar wedge spacer 1 of FIG. 1 is only effective where the pair of tiles 13 and 15 are separated by a relatively narrow gap 11 in the manner shown at FIG. 2A. However, the same planar wedge spacer 1 may not be effective in cases where the gap 11 is very wide and/or the tiles 13 and 15 are thin. Because the tile engaging top surface 5 is planar, the triangular body 3 of the wedge spacer 1 can be pushed only a short distance through the gap 11 until the tip 7 strikes the wall 17 through the mortar 19. Thus, much of the triangular body 3 of planar wedge spacer 1 (particularly the back 9 thereof with the greatest height) remains outside the gap 11 and plays no role in keeping the tiles 13 and 15 apart. Therefore, in certain situations, a single planar wedge spacer 1 like that described above may not be adequate to prevent the upper tile 13 from sliding along the wall 17 and shifting its position towards the lower tile 15.

SUMMARY OF THE INVENTION

A rotatable wedge tile spacer is disclosed to be removably located in a gap between a pair of adjacent tiles that are positioned one above the other to be bonded to a wall or similar flat surface. The rotatable wedge spacer includes a curved (i.e., circular) body having a tile-supporting top surface that runs from a thin tip at one end to a thick tail at the opposite end. In a first preferred embodiment, the height of the tile-supporting top surface around the circular body increases uniformly and continuously. In another preferred embodiment, the height of the tile-support top surface around the circular body increases incrementally.

The rotatable wedge tile spacer is held in place in the gap between the pair of tiles. With the wedge spacer seated upon the lower one of the pair of tiles, the circular body is rotated around its longitudinal axis so that the height of the circular body is correspondingly increased until the tile-supporting top surface thereof engages the upper tile of the pair of tiles. Accordingly, the circular body of the wedge spacer fills the gap to prevent the upper tile from sliding along the wall under the influence of gravity towards the lower tile, whereby the original positions of the tiles will be preserved throughout the bonding process. Prior to the mortar becoming fully dried and hardened, the rotatable wedge tile spacer is removed from the gap which may be later filled with grout. The rotatable wedge tile spacer of this invention having a curved (i.e., circular) body is an improvement over the conventional triangular wedge tile spacer having a linear body.

DESCRIPTION OF THE PREFERRED EMBODIMENT

Figure 1:
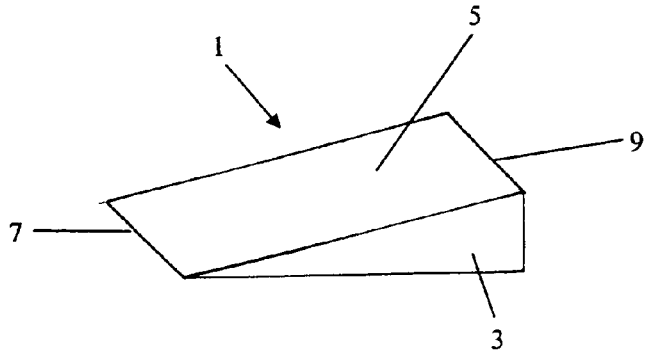
FIG.1 (Prior Art)
FIG. 1 illustrates a conventional planar wedge tile spacer.
Figure 2A:
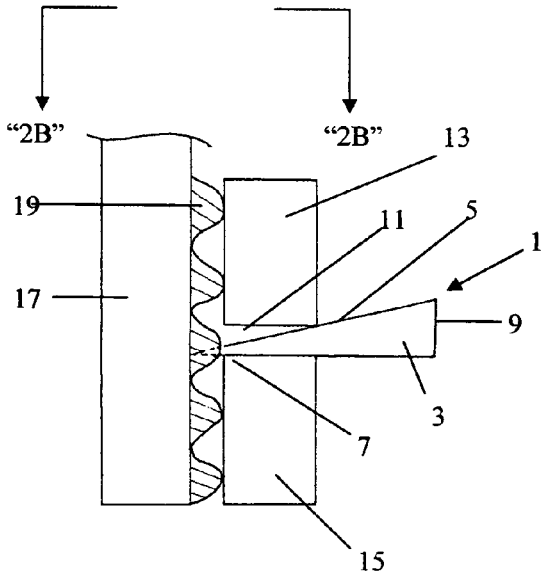
FIG.2A (Prior Art)
FIG. 2A shows the conventional planar wedge spacer of FIG. 1 located between and separating a pair of adjacent tiles to be bonded to a vertical wall.
Figure 2B:
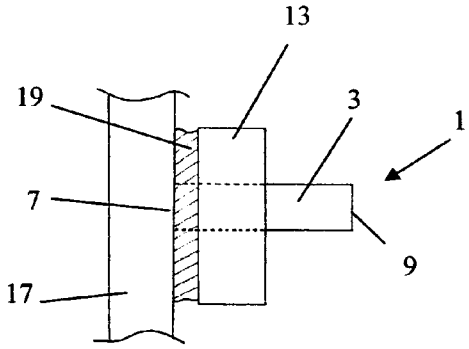
FIG.2B (Prior Art)
FIG. 2B is a top view taken along lines 2B-2B of FIG. 2A.

Referring concurrently to FIGS. 3A-3D of the drawings, there is shown a rotatable wedge tile spacer 30 according to a first preferred embodiment of this invention which represents an improvement over the conventional planar wedge tile spacer 1 shown in FIGS. 1 and 2. The rotatable wedge tile spacer 30 is preferably molded from plastic. However, the material and method for manufacturing wedge spacer 30 should not be regarded as a limitation of this invention. The rotatable wedge tile spacer 30 includes a circular body 32 having a tile-supporting top surface 34 that extends from a thin tip 36 at one end thereof to a thick tail 38 at the opposite end. The circular body 32 of spacer 30 lies in co-axial alignment with a longitudinal axis 40 (best shown in FIG. 3A). At least some of the circular body 32 defines an arc of a circle that surrounds the longitudinal axis 40 so as to maintain a constant radius (best shown in FIG. 3B) and have an ideal outside diameter of approximately 2.5 cm.

The height of the circular body 32 of wedge spacer 30 varies uniformly and continuously along the tile-supporting top surface 34 from the thin tip 36 to the thick tail 38. The maximum height of the wedge spacer 30 at the thick tail 38 is ideally approximately 1.0 cm. To this end, the tail 38 (best shown in FIG. 3A) has a generally rectangular shape. However, the tail 38 of circular body 32 may have other suitable shapes, such as that of a triangle, an arch or a circle.

Figure 3B:
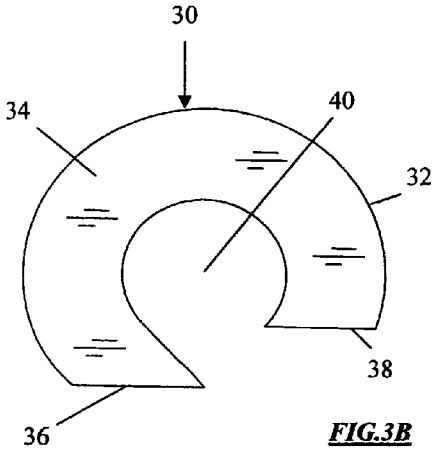
FIG. 3B is a top view of the rotatable wedge tile spacer of FIG. 3A.
Figure 3A:
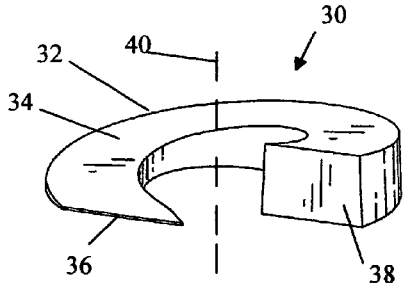
FIG. 3A is a perspective view of an improved rotatable wedge tile spacer having a circular body according to a first preferred embodiment of this invention.
Figure 3C:
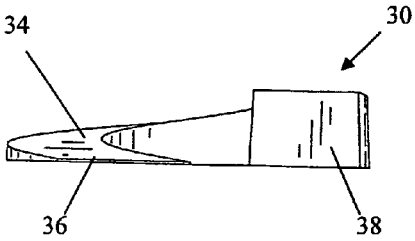
FIG. 3C is a front view of the rotatable wedge tile spacer of FIG. 3A.
Figure 3D:
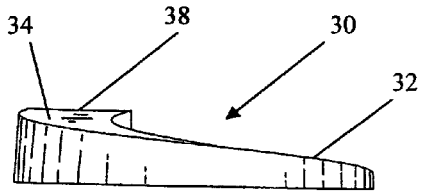
FIG. 3D is a rear view of the rotatable wedge tile spacer of FIG. 3A.

As is best shown in FIG. 3C, the thin tip 36 (i.e., the location where the height of the circular body 32 of the rotatable wedge tile spacer 30 is the smallest) creates a tapered surface similar to that of the conventional planar wedge spacer 1. Also like the conventional wedge spacer 1, the height of the circular body 32 of the rotational wedge spacer 30 of FIGS. 3A-3D increases uniformly and continuously along the tile-supporting top surface 34 in a direction running from the tip 36 to the tail 38. However, by virtue of its circular body 32, the rotatable wedge spacer 30 reaches its maximum height over a shorter distance (i.e., diameter) than the linear distance that is consumed by the planar wedge spacer 1, the particular advantage of which will now be explained.

Figure 4A:
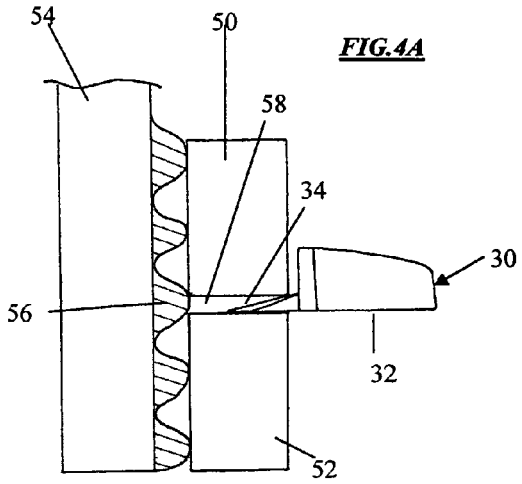
FIGS. 4A and 4B show the rotatable wedge tile spacer of FIGS. 3A-3D located in a gap of relatively small width between a pair of tiles being bonded to a vertical wall.
Figure 4B:
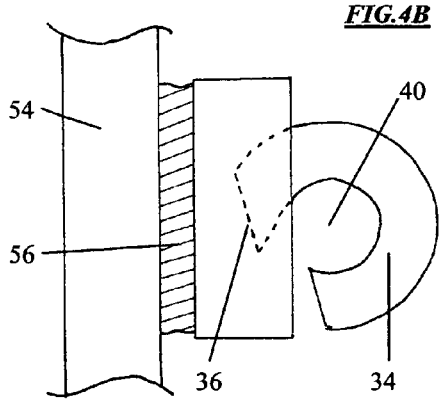

Referring initially in this regard to FIGS. 4A and 4B of the drawings, the rotatable wedge tile spacer 30 of FIGS. 3A-3D is shown after being inserted between a pair of adjacent tiles 50 and 52 that are positioned one above the other so as to be bonded to a vertical surface or backing 54 (i.e., a wall) by means of mortar 56 or a similar adhesive. In the example of FIGS. 4A and 4B, a relatively small (i.e., thin) gap 58 separates the upper and lower tiles 50 and 52 from one another. The thin tip 36 of the circular body 32 of the rotatable wedge spacer 30 is pushed towards the mortar 56 so as to be located and retained between the upper and lower tiles 50 and 52. The circular body 32 is first seated upon the bottom tile 52. Provided that the gap 38 has not been filled by the thin tip 36, the circular body 32 is rotated slightly around its longitudinal axis 40 until the tile engaging top surface 34 of body 32 engages the upper tile 50. That is to say, the particular rotation of the circular body 32 of the rotatable wedge spacer 30 corresponds to the size of the gap 58 and the height of the circular body required to fill the gap and prevent the upper tile 50 from sliding along the wall 54 towards the lower tile 52 to thereby preserve the spacing between the tiles throughout the bonding operation. Shortly before the mortar 56 has set and hardened so that the tiles will be immovably affixed to the wall 54, the wedge spacer 30 is pulled outwardly from the gap 58. However, the tiles 50 and 52 will now be held in place against the wall 54 to prevent shifting and maintain their original alignment relative to one another. Once the mortar 56 has fully hardened, the gap 58 can be filled with grout or any other structurally-supportive material.

Figure 5A:
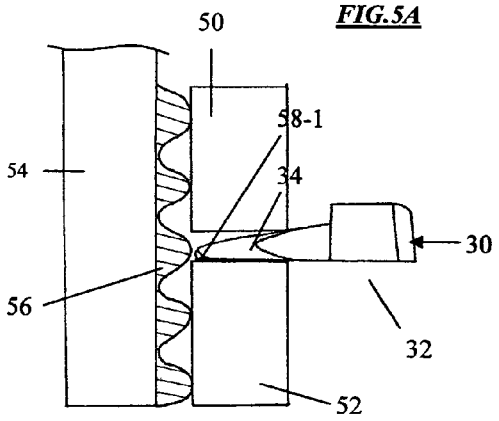
FIGS. 5A and 5B show the rotatable wedge tile spacer of FIGS. 3A-3D located in a gap of medium width between a pair of tiles being bonded to a vertical wall.
Figure 5B:
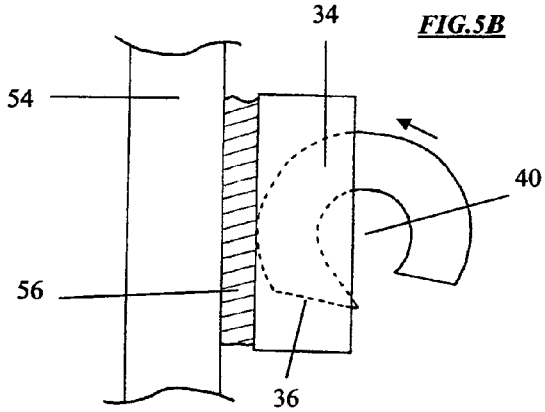

Turning now to FIGS. 5A and 5B of the drawings, the rotatable wedge tile spacer 30 is shown inserted in a gap 58-1 between the pair of adjacent tiles 50 and 52 that are positioned one above the other to be bonded to the wall 54. In this case, the gap 58-1 is larger (i.e., wider) than the gap 58 shown at FIG. 4A into which the wedge spacer 30 is inserted. As earlier described, the circular body 32 of wedge spacer 30 is seated upon the bottom tile 52. To account for the relatively wide dimension of the gap 58 shown in FIG. 5A, the circular body is now rotated in a counter-clockwise direction (as indicated by the reference arrow in FIG. 5B) around its longitudinal axis 40 until the tile-supporting top surface 34 thereof engages the upper tile 50. At this point, the circular body 32 will fill the gap 58-1 so as to prevent the upper tile 50 from sliding along the wall 54, through the gap 58-1, and shifting towards the lower tile 52. Because of the ability to continuously rotate the tile spacer 30 within the relatively wide gap 58-1 of FIG. 5A, the height of the circular body 32 required to fill the gap 58-1 can be selectively adjusted in order to preserve the original spacing between the tiles 50 and 52 throughout the bonding operation.

Figure 6A:
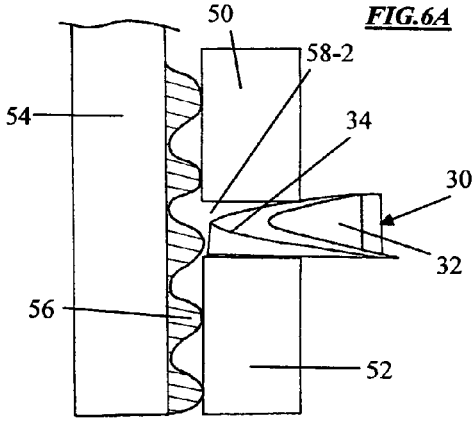
FIGS. 6A and 6B show the rotatable wedge tile spacer of FIGS. 3A-3D located in a gap of relatively large width between a pair of tiles being bonded to a vertical wall.
Figure 6B:
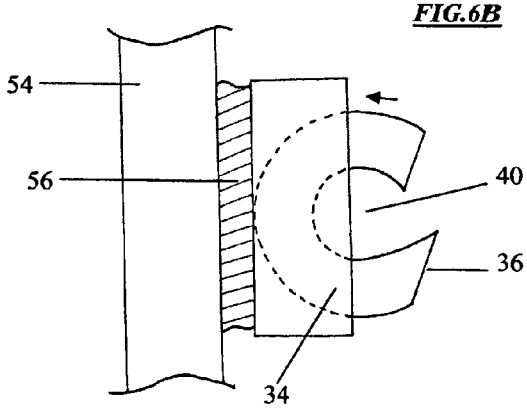

Referring to FIGS. 6A and 6B of the drawings, the rotatable wedge tile spacer 30 is shown inserted in a gap 58-2 which is wider than either of the gaps 58 or 58-1 of FIGS. 4A and 5A. Once it is seated upon the bottom tile 52 of the pair of tiles 50 and 52, the circular body 32 of tile spacer 30 is rotated in a counter-clockwise direction (as indicated by the reference arrow in FIG. 6B) around its longitudinal axis 40 until the tile-supporting top surface 34 engages the upper tile 50, whereby to prevent the upper tile 50 from sliding along the wall 54 towards the lower tile 52. In order to fill the relatively wide gap 58-2, the circular body 32 is continuously rotated to correspondingly increase the height thereof until the rotatable wedge tile spacer 30 fits snugly between the adjacent tiles 50 and 52.

It may be appreciate that the circular body 32 of the rotatable wedge tile spacer 30 can be rotated around its longitudinal axis 40 through any angle until the height of the circular body is correspondingly increased within any gap so as to enable the tile-supporting top surface 34 to engage the upper tile 50 from the pair of tiles 50 and 52 whose positions along the wall 54 are to be preserved. Unlike the conventional planar wedge tile spacer 1 of FIGS. 1, 2A and 2B having a linear tile supporting top surface 5, where only a portion of the triangular body 3 can be inserted into most gaps located between adjacent tiles 13 and 15, the circular body 32 of the improved rotatable wedge tile spacer 30 can be selectively rotated around its longitudinal axis 40 through any angle so that the entire tile-supporting top surface 34 is available to engage the upper tile 50 and thereby completely fill the gap and preserve the initial spacing of the tiles.

Figure 7B:
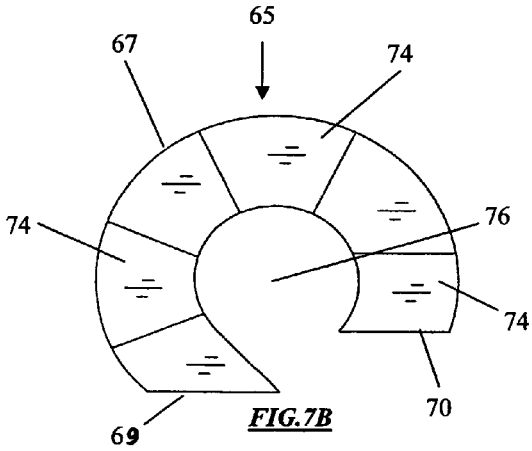
FIG. 7B is a top view of the rotatable wedge tile space of FIG. 7A.
Figure 7A:
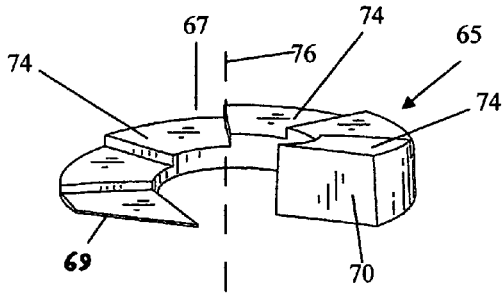
FIG. 7A is a perspective view of an improved rotatable wedge tile spacer having a circular body according to another preferred embodiment of this invention.

A rotatable wedge tile spacer 65 according to another preferred embodiment of this invention is shown in FIGS. 7A and 7B of the drawings. The rotatable wedge tile spacer 65 of FIGS. 7A and 7B has a circular body 67 like that designated 32 and earlier described while referring to FIGS. 3A-3D. However, rather than having a height that increases uniformly and continuously therearound, the height along the circular body 67 of wedge spacer 65 increase incrementally between a thin tip 69 at one end and a thick tail 70 at the opposite end. That is to say, the tile-supporting top surface of body 67 includes a series of steps 74 with each successive step being higher than the previous step. The step circular body 67 of the rotatable wedge tile spacer 65 is rotatable around a longitudinal axis 76 to achieve the same advantages that are available by virtue of the rotatable wedge tile spacer 65 as previously disclosed.

The rotatable wedge tile spacers 30 and 65 herein disclosed have been described as having a circular body 32 and 67, respectively. However, this circular body should be understood to mean any curved body that can be rotated so that the height of the body is correspondingly increased in order to fill a gap between a pair of adjacent tiles 50 and 52 to prevent movement of the tiles through the gap.

In this same regard, while the rotatable wedge spacers 30 and 65 have particular application to fill a gap between a pair of tiles, the spacers 30 and 65 can also be advantageously used in the construction industry wherever a gap must be maintained between adjacent surfaces such as, for example, wood flooring laid on a concrete slab alongside a vertical wall, but there is insufficient space in the gap to insert a linear wedge.

The invention claimed is:

1. A combination comprising:

a first tile attached to a surface;

a second tile attached to the surface, said first and second tiles being spaced from one another by a gap therebetween; and a tile spacer to be removably positioned in said gap, said tile spacer including a curved body having a center, a bottom surface, a tile-supporting top surface, a wedge-shaped tip at a first end of said curved body, and a tail at the opposite end of said curved body, the height of said curved body between said bottom surface and said tile supporting top surface increasing from the wedge-shaped tip at the first end of said curved body to the tail at the opposite end of said curved body, said tile spacer also including an opening that runs completely through the center of said curved body, said opening surrounded by the bottom surface and the tile supporting top surface of said curved body, said opening being sized so as to lie in the gap between said first and second tiles when said tile spacer is positioned in said gap, the wedge-shaped tip at the first end of said curved body being separated from the tail at the opposite end of said curved body by a space that communicates with the opening through the center of said curved body.

2. The combination recited in claim 1, wherein the height of said curved body increases uniformly and continuously from the wedge-shaped tip at the first end of said curved body to the tail at the opposite end.

3. The combination recited in claim 1, wherein the height of said curved body increases incrementally from the wedge-shaped tip at the first end of said curved body to the tail at the opposite end.

4. The combination recited in claim 3, wherein the tile-supporting top surface of said curved body has a series of steps formed therein, the height of said curved body increasing incrementally at each successive step along said tile-supporting top surface from the wedge-shaped tip at the first end of said curved body to the tail at the opposite end.

5. The combination recited in claim 1, wherein the curved body of said tile spacer is a circular body having said opening running through the center thereof and a longitudinal axis extending through said opening in co-axial alignment with said circular body, said circular body being rotatable within said gap around said longitudinal axis, the bottom surface of said circular body adapted to lay upon said second tile and the tile-supporting top surface of said circular body adapted to engage said first tile, whereby said circular body fills the gap to prevent said first tile from moving through said gap towards said second tile.

6. The combination recited in claim 1, wherein the height of the wedge-shaped tip at the first end of said curved body is less than the height of said tail at the opposite end thereof.

7. The combination recited in claim 1, wherein at least some of the curved body of said tile spacer forms an arc of a circle having a constant radius.

8. For maintaining a gap between a pair of surfaces that lie adjacent one another and that are separated from one another by said gap, a spacer to be removably positioned in said gap, said spacer including a curved body having a center, a flat bottom, a top having a plurality of flat areas located one after the other around said curved body and lying parallel to said flat bottom, a wedge-shaped tip at a first end of said curved body and a tail at the opposite end, the height of said curved body between said flat bottom and successive ones of said plurality of flat areas of said top increasing from the wedge-shaped tip at the first end of said curved body to the tail at the opposite end thereof, said spacer also including an opening that runs completely through the center of said curved body, said opening surrounded by the flat bottom and the top of said curved body, said opening being sized so as to lie in the gap between said first and second surfaces when said spacer is positioned in said gap, the wedge-shaped tip at the first end of said curved body being separated from the tail at the opposite end of said curved body by a space that communicates with the opening through the center of said curved body.

* * * * *